United States Patent [19]

Corain et al.

[11] Patent Number: 5,007,463

[45] Date of Patent: Apr. 16, 1991

[54] WEFT CLAMPING SYSTEM FOR INSERTER RAPIER

[75] Inventors: Luciano Corain; Gianni Maitan, both of Vicenza; Renato Perlini, Verona; Mario Bacchetti, Padua, all of Italy

[73] Assignee: Nuovopignone-Industrie Meccaniche e Fonderia, S.p.A., Florence, Italy

[21] Appl. No.: 389,305

[22] Filed: Aug. 3, 1989

[30] Foreign Application Priority Data

Aug. 19, 1988 [IT] Italy ..... 21718 A/88

[51] Int. Cl.[5] ..... D03D 47/20

[52] U.S. Cl. ..... 139/448

[58] Field of Search ..... 139/448, 447, 438, 439, 139/443

[56] References Cited

U.S. PATENT DOCUMENTS

| | | | |
|---|---|---|---|
| 3,851,676 | 12/1974 | Kokkinis | 139/448 |
| 4,284,108 | 8/1981 | Porter et al. | 139/448 |
| 4,875,505 | 10/1989 | Moeneclaey et al. | 139/448 |

*Primary Examiner*—Andrew M. Falik

*Attorney, Agent, or Firm*—Morgan & Finnegan

[57] ABSTRACT

A weft inserter rapier for shuttleless weaving looms in which the weft clamping and retaining system comprises an elastic clamping foot the cross-section of which has a reverse-"U"-shape which is urged, due to the action of a spring-loaded lever, against two metal blades resting on two supports made from an elastomeric material. The metal blades may be provided with an upwards-protruding step at their adjacent ends inside said clamping foot, and the clamping foot can be linked by a semispherical articulated joint to a spring-loaded lever.

4 Claims, 3 Drawing Sheets

WEFT CLAMPING SYSTEM FOR INSERTER RAPIER

The present invention relates to improvements in a weft inserter rapier and, more specifically, it relates to a new system for clamping and retaining the weft in said type of rapier. Two points of transversal clamping of the weft on different support planes spaced apart from each other and independent from each other are provided making it possible for the clamping surfaces to be adapted in an optimum way for. Therefore, the weft clamping forces are distributed more efficaciously and a more reliable and efficacious clamping is achieved even in the case of heterogeneous and irregular wefts, and, above all, in case of double wefts.

It is well known that in the shuttleless weaving looms, the wefts are inserted by means of two weft inserter rapier. The rapiers are mounted on conveyor tapes and are moved by a reciprocating motion from the opposite sides of the weaving loom inside the shed of the warp yarns. At the center of the shed, the weft inserter rapier, which took the weft coming from the feed bobbin at one side of the weaving loom, and keeps the weft clamped by means of its clamping system, gives said weft to the opposite-side, weft pulling rapier, which slides the weft off from the inserter rapier, bringing it off the warp shed, on the other side of the weaving loom.

Now, the increasing operating speeds required in the modern weaving looms impose an extreme mechanical simplification of the weft inserter rapier, and has caused an increasing complexity of the weft clamping and retaining systems in said rapier types. Several weft clamping and retaining systems for weft inserter rapiers are already known, which substantially adopt a clamping foot which can be either rigid or flexible, and which cooperates with a rigid clamping plane.

Unfortunately, these prior art solutions are disadvantageous in that that they do not secure an efficacious clamping and retaining action in case of irregular wefts. This is an especial drawback the case of double wefts where it is clearly necessary that the machine provide at least two independent clamping points which are sufficiently spaced apart from each other so as not to be simultaneously influenced by the irregularity of the weft.

Clamping feet which urge against the clamping plane in two points are known from the prior art. But, this known solution does not solve the above said problem, in that it does not provide the independence of the two clamping points from each other, and the proper distance.

The purpose of the present invention is precisely of obviating these drawbacks, and of providing a weft clamping and retaining system for a weft inserter rapier which is effective with irregular wefts and of double wefts.

The above purpose is substantially achieved by the use of an elastic clamping foot the cross-section of which has a reverse-"U"-shape. Each one of both of the side walls of the reverse "U", spaced apart from each other, is urged against a metal blade supported on a horizontal clamping plane provided along the external edge of the body of the same rapier, through a support made of an elastomeric material.

Two clamping points are accomplished which are suitably spaced apart from each other and are independent from each other. The elasticity of the elastomeric material makes possible the efficacious clamping of wefts of variable diameter.

In the specific case of double wefts, according to a further feature of the present invention, the metal blades on which the mutually spaced-apart side walls of the elastic clamping foot are urged are provided with an upwards-protruding step at their adjacent ends. This shapes the blades so as to create inside the hollow defined by the reverse-"U"-shape of said elastic clamping foot a longitudinal shoulder and generates a labyrinth-shaped path for the wefts to be clamped. This makes, for easier transversal clamping of the wefts between the clamping surfaces.

In another embodiment of the present invention, the elastic clamping foot is swingingly linked to the spring-urged lever which keeps it urged against the clamping plane by means of a semispherical articulated joint. The articulated joint while being integral with said clamping foot, is kept inside the semispherical hollow of said lever by a leaf spring which, anchored onto the same lever, acts on said foot from down upwards.

In that way, the clamping foot can easily match any irregularities in the weft and secure its clamp on the weft.

The present invention is disclosed now in greater detail by referring to the drawings which illustrate a preferred form of practical embodiment and are given for merely exemplifying purposes and are in no way limiting of the present invention. Technical or structural modifications may be supplied at any time without departing from the purview of the present invention.

So, for example, instead of an elastic clamping foot having a cross-section with a reverse- "U"-shape, an elastic clamping foot can be used which has an uniform rectangular cross-section and is kept urged against two metal blades supported by a support of an elastomeric material and situated in correspondence of its longitudinal edges.

DETAILED DESCRIPTION OF THE DRAWINGS

Figure 1:
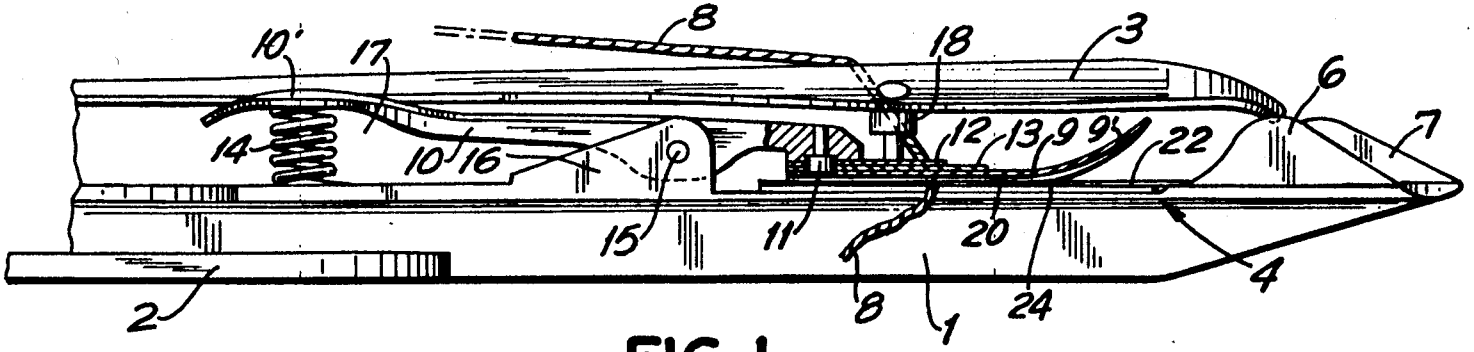
FIG. 1 shows a partial longitudinal, partially sectional view of a weft inserter rapier using the weft clamping and retaining system according to the present invention.
Figure 2:
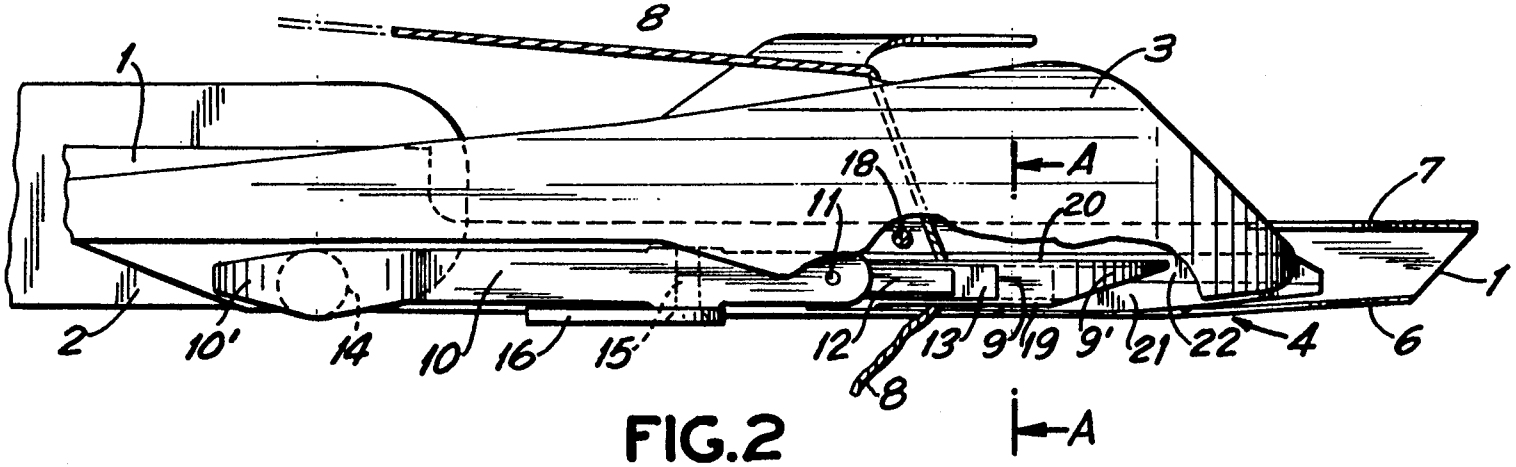
FIG. 2 shows a partially sectional top plan view of the rapier of FIG. 1.

Referring to the Figures, by means of the reference numeral 1 the rapier body is shown of a weft inserter rapier which is mounted on the conveyor belt 2.

The rapier body 1 is provided with an upper protection cover 3 and, along its outer edge 4, with a horizontal clamping plane 5 which ends, at its front end, with the two tips 6 and 7 which perform the task of guiding the weft 8 under an elastic clamping foot 9 which, in order to accomplish the intended purpose, is bent upwards at its front portion 9', precisely in order to facilitate the insertion and the clamping of the weft 8 between the two clamping surfaces.

The elastic clamping foot 9 is then kept elastically urged against said horizontal clamping plane 5 by the action of a lever 10, to an end of which it is fastened by means of the screw 11 together with the elastic blades 12 and 13 which are provided in order to vary the bending stiffness in the longitudinal direction of the same foot.

The other end 10' of the lever 10 is urged upwards by the spring 14 and the lever is hinged by the pivot 15 between an appendix 16 and an intermediate wall 17 of said rapier body 1. End 10' of the lever is accessible from outwards and acts as a pressor in order to open, on command, the clamping apparatus of the weft inserter rapier for cleaning purposes, when the yarn fluff deposited between said clamping apparatus has to be removed. In the figures, the weft stroke limit stud 18 is also shown.

Figure 3:
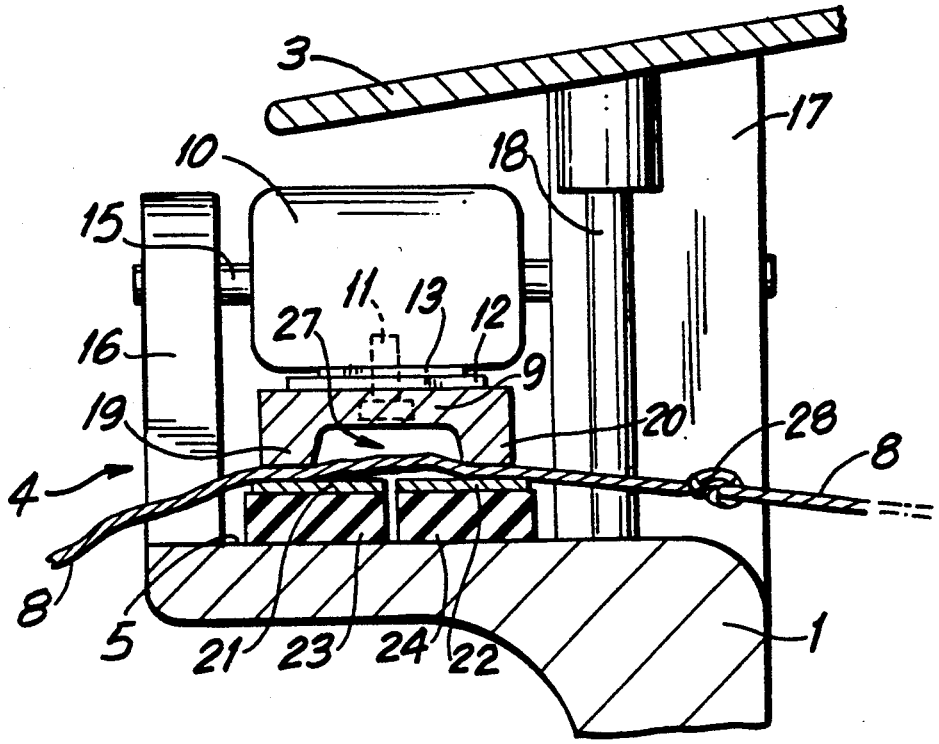
FIG. 3 shows a greatly magnified front view of a different form of practical embodiment of the invention, made according to AA path of FIG. 2.

Elastic clamping foot 9 is then accomplished according to the invention with its cross-section being substantially given the shape of a reverse-"U" (specific reference is made to FIGS. 3 and 4) with its side walls 19 and 20, considerably spaced apart from each other, being each urged against a metal blade, respectively 21 and 22, which in its turn is supported by a support made from an elastomeric material, respectively 23 and 24, fastened onto said clamping plane 5.

Figure 4:
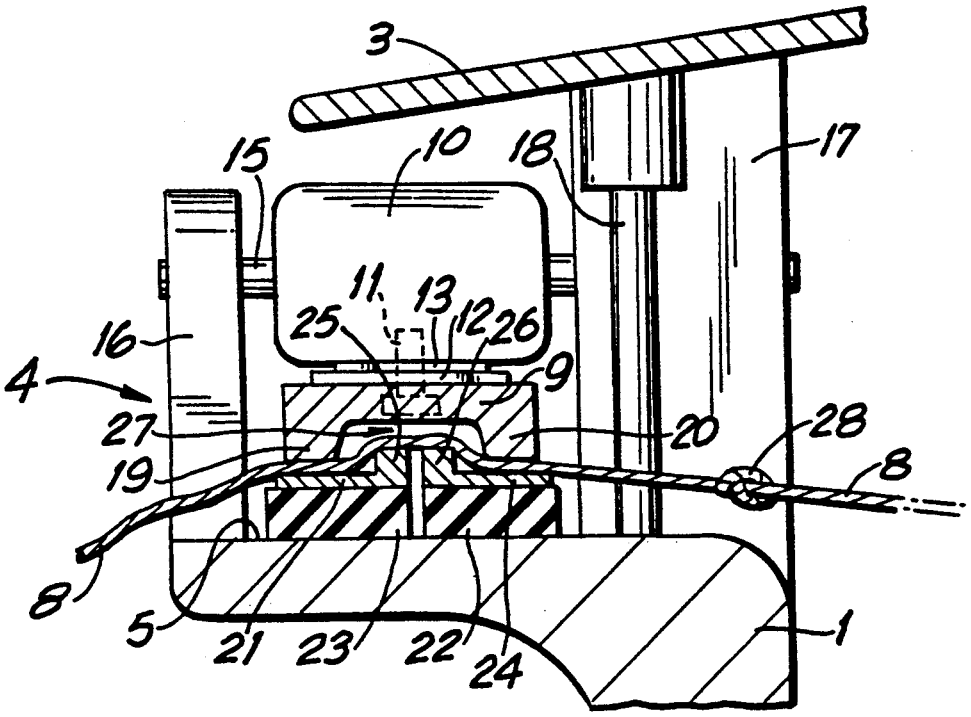
FIG. 4 shows a front view similar to the front view of FIG. 3, of a different form of practical embodiment of the invention.

Then, according to the form of practical embodiment shown in FIG. 4, said metal blades 21 and 22 are provided with an upwards protruding step, respectively 25 and 26, at their adjacent ends inside the hollows 27 of the clamping foot 9, so as to create longitudinal shoulder 32, 33 a labyrinth path for the weft 8, as seen in FIG. 4.

Therefore, by means of said forms of practical embodiment and efficacious clamping of the weft is secured even in the presence of irregularities 28 in said weft.

Figure 5:
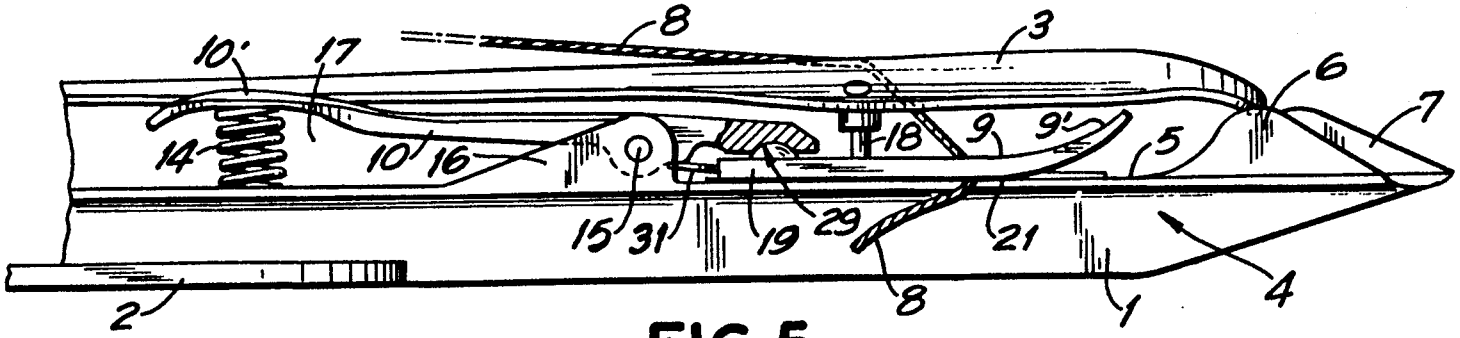
FIG. 5 shows a partial longitudinal view similar to the view of FIG. 1, of another different form of practical embodiment of the invention.
Figure 6:
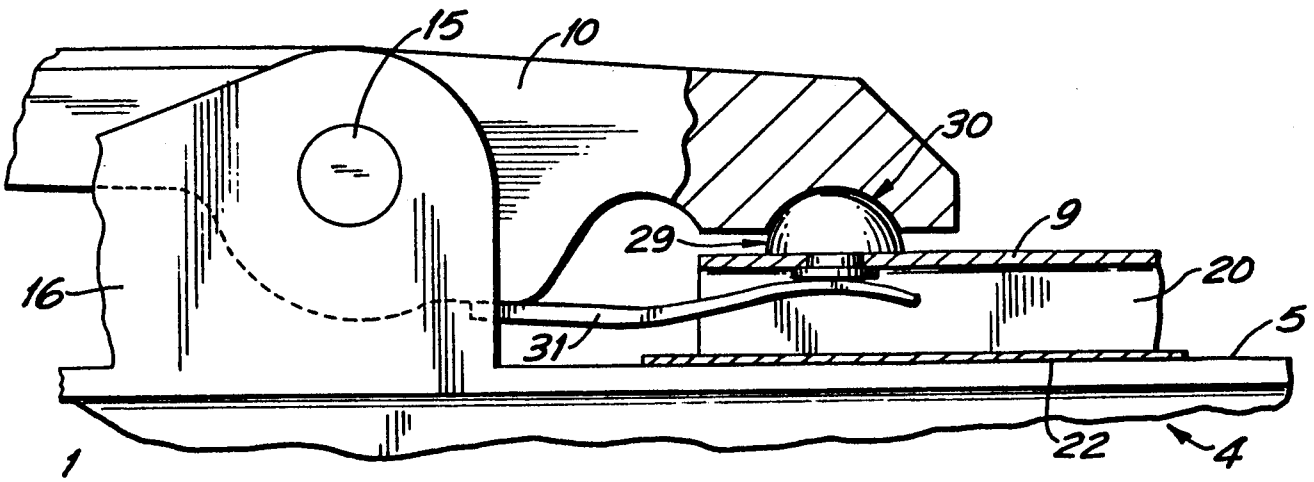
FIG. 6 shows a greatly enlarged view of the form of practical embodiment of FIG. 5.

In FIGS. 5 and 6, the elastic clamping foot 9, instead of being rigidly fastened by means of the screw 11, is swingingly linked with the end of the lever 10 by means of a semispherical articulated joint 29 which, mounted on foot 9 with the possibility of rotating, is kept inside the semispherical hollow 30 of the end of lever 10 of leaf spring 31, which is anchored onto the same lever 10, and acts on said foot 9 from below upwards.

We claim:

1. A weft inserter rapier for shuttleless weaving looms comprising a weft clamping and retaining system, said weft clamping and retaining system having an elastic clamping foot which is urged by a spring-loaded lever with which said clamping foot is linked against a horizontal clamping plane provided along an external edge of a body of the rapier, in which said elastic clamping foot has a cross-section which has a substantially reverse-"U"-shape, said substantially reverse "U" shape cross-section defining side walls in which each of both of the side walls are spaced apart from each other and are urged against adjacent metal blades which are supported on said horizontal clamping plane through a support made of an elastomeric material.

2. A weft inserter rapier for shuttleless weaving looms according to claim 1, in which said metal blades on which the mutually spaced-apart side walls of said elastic clamping foot are urged are each provided with an upwards-protruding step at their adjacent ends, so as to create inside a hollow defined by the reverse-"U"-shape of said elastic clamping foot, a longitudinal shoulder generating a labyrinth-shaped path for the wefts to be clamped.

3. A weft inserter rapier for shuttleless weaving looms according to any one of the preceding claims, in which said elastic clamping foot is swingingly linked to a spring-urged lever which keeps said elastic clamping foot urged against the clamping plane, said linkage being a semispherical articulated joint which is integral with said clamping foot and is kept inside the semispherical hollow of said lever by a leaf spring, said leaf spring being anchored to the same lever and the leaf spring acts on said foot from below and urges the foot upwardly.

4. A weft inserter rapier for shuttleless weaving looms according to claim 1, in which said elastic clamping foot has an uniform cross-section and is supported in said clamping and retaining system so that the longitudinal edges of the clamping foot are urged against said metal blades.

* * * * *